United States Patent [19]

Fukuroi

[11] 4,388,751

[45] Jun. 21, 1983

[54] METHOD AND APPARATUS FOR MANUFACTURING SLIDE FASTENER COUPLING ELEMENTS

[75] Inventor: Takeo Fukuroi, Uozu, Japan

[73] Assignee: Yoshida Kogyo K. K., Tokyo, Japan

[21] Appl. No.: 201,695

[22] Filed: Oct. 29, 1980

[30] Foreign Application Priority Data

Oct. 29, 1979 [JP] Japan ..... 54-139706

[51] Int. Cl.[3] ..... B21D 53/52

[52] U.S. Cl. ..... 29/410; 29/766

[58] Field of Search ..... 24/205.13 C; 29/34 A, 29/33.2, 410, 766, 769; 72/196, 197, 332

[56] References Cited

U.S. PATENT DOCUMENTS 2,596,888 5/1952 Cohn ..... 29/410

2,734,546 2/1956 Firing ..... 29/769 X 3,068,549 12/1962 Firing ..... 29/34 A X 3,187,540 6/1965 MacBroom ..... 72/197

*Primary Examiner*—Ervin M. Combs

*Attorney, Agent, or Firm*—Hill, Van Santen, Steadman, Chiara & Simpson

[57] ABSTRACT

A blank rod of metal has a substantially Y-shaped cross section including a pair of V-shaped diverging legs each having a longitudinal rib on midportions of its inner surface. The blank rod is intermittently fed in a longitudinal direction as each of the ribs is pressed by a presser roll having series of die teeth into a succession of projections or teeth longitudinally spaced an interval from each other. The blank rod is then transversely sliced substantially centrally across each tooth on at least one of the legs into a plurality of individual slide fastener coupling elements.

3 Claims, 14 Drawing Figures

METHOD AND APPARATUS FOR MANUFACTURING SLIDE FASTENER COUPLING ELEMENTS

BACKGROUND OF THE INVENTION

1. Field of the Invention

The present invention relates to a method and apparatus for manufacturing slide fastener coupling elements of the discrete type.

2. Prior Art

U.S. Pat. No. 3,187,540, patented June 8, 1965, discloses a process and apparatus for manufacturing slide fastener coupling elements each having indentations in confronting inner surfaces of legs of the coupling element. Formation of such indentations however results in a reduction in mechanical strength of the legs of the coupling elements, such that gripping power on a stringer tape is weakened when attached to the latter.

SUMMARY OF THE INVENTION

A pair of longitudinal ribs on midportions of confronting inner surfaces of a pair of V-shaped diverging legs of a blank rod of metal which is of a substantially Y-shaped cross section, are each pressed by a presser roll having a series of die teeth into a succession of projections or teeth longitudinally spaced an interval from each other. The blank rod is then sliced substantially centrally across each tooth on at least one of the legs into a plurality of individual slide fastener coupling elements. The teeth on one of the legs may substantially be aligned with or out of alignment with the teeth on the other leg by half the interval. The presser roll is cooperative with other rolls in defining a substantially Y-shaped space through which the blank rod can be longitudinally fed for the formation of the teeth on the legs.

It is an object of the present invention to provide a method of and an apparatus for manufacturing slide fastener coupling elements having increased holding power on a stringer tape.

Another object of the present invention is to provide a method of and an apparatus for manufacturing slide fastener coupling elements having increased hardness gained by work hardening that is effected when the coupling elements are formed.

Still another object of the present invention is to provide a method of and an apparatus for manufacturing slide fastener coupling elements having a cross-sectional shape dimensioned as desired successively at a high rate of production.

Many other advantages, features and additional objects of the present invention will become manifest to those versed in the art upon making reference to the detailed description and the accompanying drawings in which preferred structural embodiments incorporating the principles of the present invention are shown by way of illustrative example.

DETAILED DESCRIPTION

Figure 1:
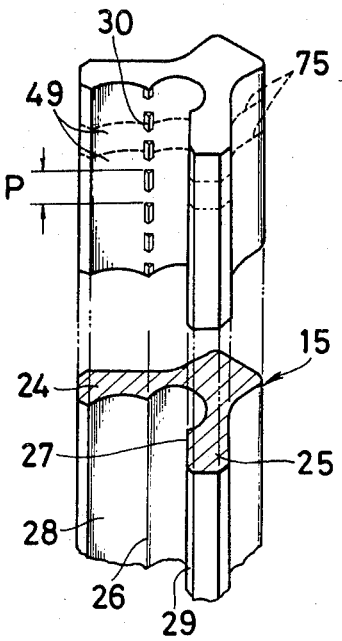
FIG. 1 is an enlarged fragmentary perspective view of a blank rod as it is processed in accordance with the present invention.

As shown in FIG. 1, a blank rod 15 of red brass having a substantially Y-shaped cross section is formed from a round wire 16 (FIG. 2) which is caused to be processed by a pair of roughing rolls 17,18 for rough rolling, a set of four mutually perpendicular rolls 19,20,21 (three shown) for shaping the wire 16, and then a pair of finishing rolls 22,23 for finish rolling. These rolls are positively driven for intermittently feeding the round wire 16 as it is rolled into the blank rod 15. The blank rod 15 thus formed includes a pair of V-shaped diverging legs 24,25 having a pair of longitudinal ribs or ridges 26,27, respectively, on midportions of confronting inner surfaces 28,29 thereof.

Figure 4:
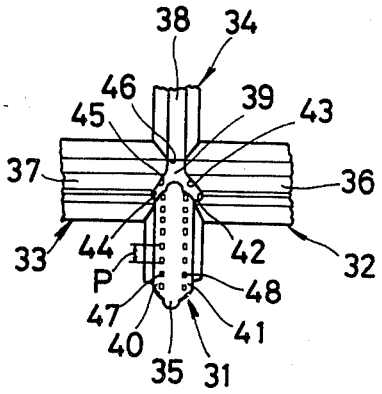
FIG. 4, appearing with FIG. 1, is a fragmentary plan view of rolls shown in FIG. 3.
Figure 5:
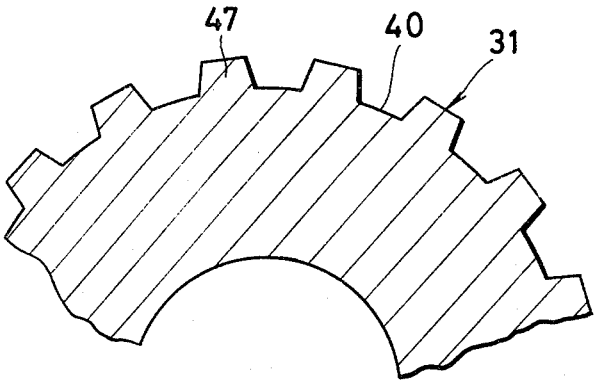
FIG. 5, appearing with FIG. 1, is an enlarged fragmentary cross-sectional view of a presser roll.

Each of the ribs 26,27 is pressed or stamped into a series of projections or teeth 30 spaced an interval or pitch P from each other. Such pressing or stamping is performed by a set of rolls 31,32,33 and 34 (FIGS. 2, 3 and 4) rotatable about axes A, B, C and D, respectively, lying in a common plane which extends substantially perpendicularly to the direction of movement of the blank rod 15. The rolls 31–34 have peripheral surfaces 35,36,37 and 38, respectively, that jointly define a substantially Y-shaped closed space 39 (FIG. 4) which lies in said common plane and is complemental with the cross section of the blank rod 15 for passage of the latter through the space 39. As illustrated in FIG. 4, the roll 31 acts as a presser die roll for forming the teeth 30 and its peripheral surface 35 is constituted by a pair of side faces 40,41 that are cross-sectionally V-shaped. The rolls 32–34 act as backing rolls for backing up the blank rod 15 as it is pressed by the presser die roll 32. The peripheral surface 36 of the roll 32 is defined by faces 42,43, the peripheral surface 37 of the roll 33 by faces 44,45 and the peripheral surface 38 of the roll 34 by a face 46. The cross-sectional contour of the blank rod 15 is thus maintained by these faces of the rolls 31–34.

Figure 3:
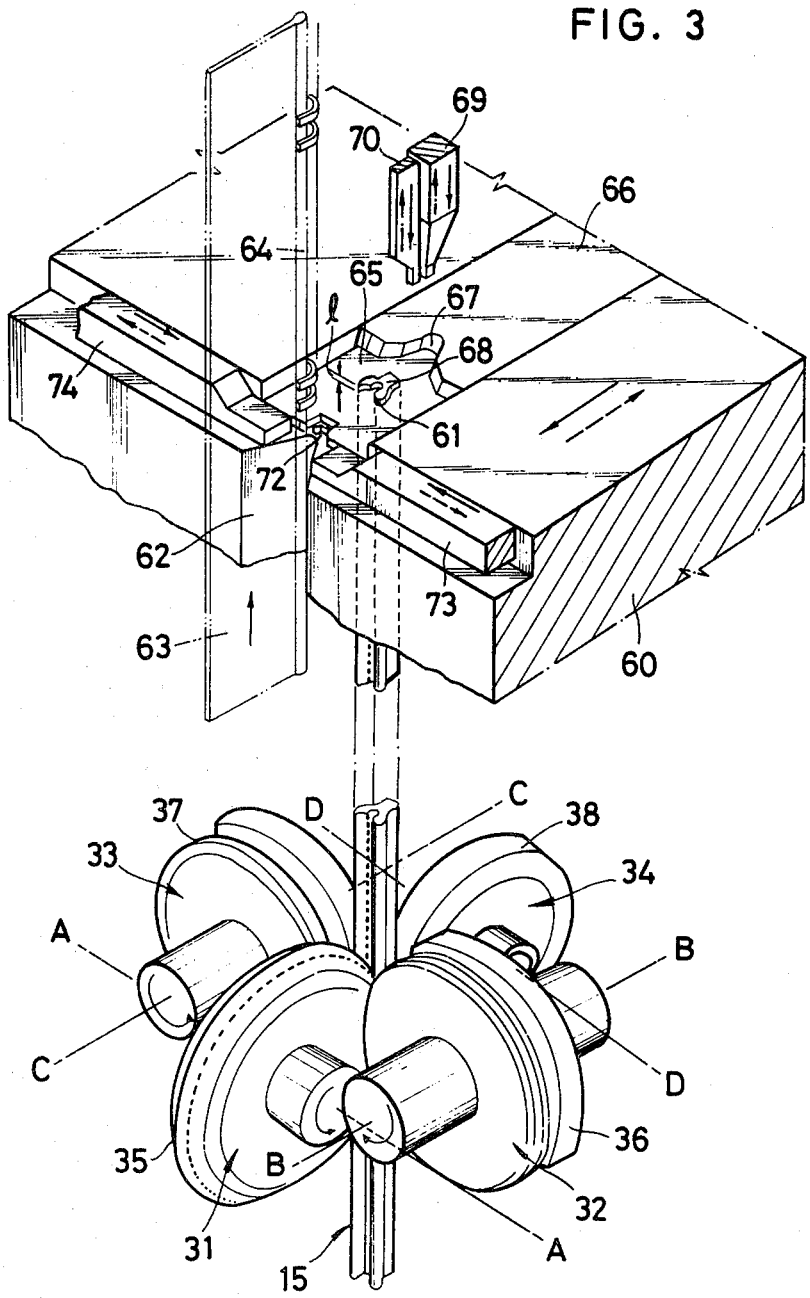
FIG. 3 is a fragmentary perspective view of the essential parts of an apparatus according to the present invention.

A pair of series of die teeth 47,48 project from the faces 40,41 of the presser die roll 31 circumferentially around the latter and are aligned with each other about the rotational axis of the presser die roll 31, the die teeth 47,48 in each row being spaced from each other by the pitch P. When the blank rod 15 is fed through the space 39 upwardly as shown in FIG. 3, the die teeth 47,48 bite into the ribs 26,27, respectively, causing spaced portions 49 (FIG. 1) below the die teeth 47,48 to be pressed and flow into adjacent regions. The blank rod 15 thus provided with the teeth 30 has increased hardness due to work hardening.

Figure 2:
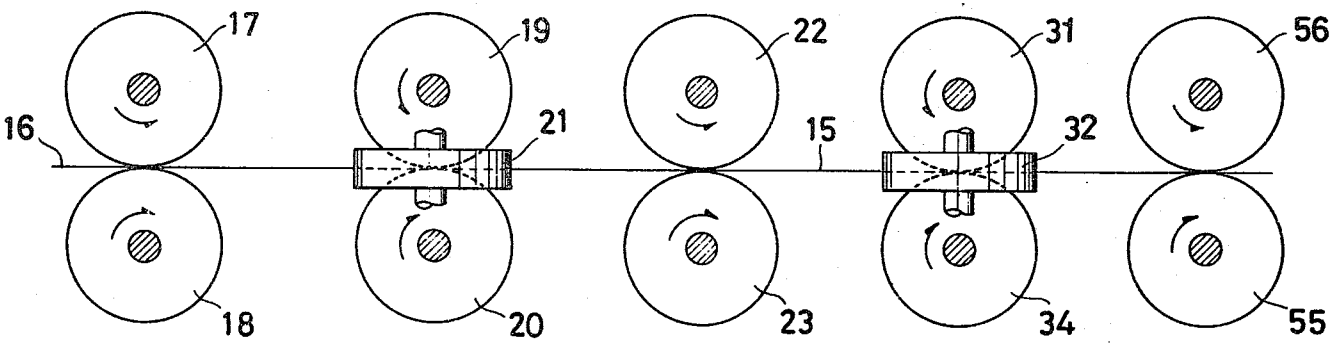
FIG. 2 is a diagram illustrative of a method according to the present invention.
Figure 6:
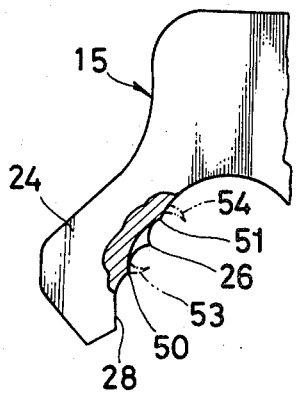
FIG. 6 is an enlarged fragmentary end view, partly in cross section, of the blank rod while being formed.

During the pressing of the ribs 26,27, bulges 50,51 (FIG. 6) tend to be created sideways of the portions 49 and may develop into burrs 53,54 or chips when the blank rod 15 is severed. To flatten the bulges 50,51, the blank rod 15 is caused to pass between a pair of finishing rolls 55,56 (FIG. 2).

The rolls 31–34 may be idly rotatable so that they can be rotated only by advancing movement of the blank rod 15 which is caused by the rolls 17–23.

As illustrated in FIG. 3, a movable block 60 has a hole 61 for passage therethrough of the blank rod 15 fed upwardly from the rolls 31–34. The block 60 has a front vertical slot 62 which is V-shaped in cross section for receiving a stringer tape 63 having a longitudinal beaded edge 64, which tape is intermittently fed upwardly in a path parallel to the direction in which the blank rod 15 moves upwardly. The block 60 also has a channel 65 in which is disposed a stationary cutter blade 66 fixed to a suitable support (not shown) having a cutting edge 67 for slicing or cutting off the blank rod 15 into a coupling element blank 68 upon retracting movement of the block 60 away from the stringer tape 63. The blank rod 15 is intermittently fed upwardly so that it projects out of the hole 61 by a length l at a time in order that the sliced coupling element blank 68 will have a thickness equal to the length l. As the block 60 is further retracted in the direction of the dashed arrow of FIG. 3, the sliced coupling element block 68 is swept by the cutting edge 67.

The coupling element blank 68 is then retained in a recess 72 at the front end of the channel 65 when the block 60 is retracted to the end of stroke of its rearward movement. At the same time, a punch 69 and a presser 70 are lowered to press the coupling element blank 68 to form a coupling head 71 (FIGS. 7 and 8) at a position where legs 76,77 are joined. Then, the punch 69 and the presser 70 are retracted upwardly, and the block 60 is moved forwardly until the slot 62 arrives at the beaded edge 64 of the tape 63, in which position the legs 76, 77 of the coupling element blank 68 are disposed astride the beaded tape edge 64. A pair of reciprocable punches 73,74 are moved toward each other to clinch the legs 76,77 about the beaded edge 64 of the tape 63 which is held at rest between intermittent movements thereof.

Figure 7:
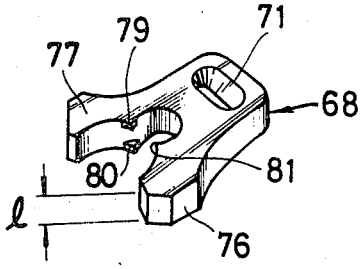
FIG. 7 is an enlarged perspective view of a slide fastener coupling element as completed in accordance with the present invention.
Figure 8:
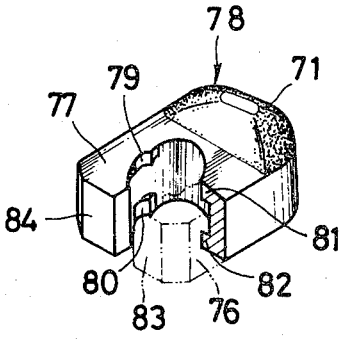
FIG. 8 is an enlarged perspective view, partly cut away, of a slide fastener coupling element as completed and deformed when assembled to a stringer tape.

The blank rod 15 is sliced substantially centrally across each tooth 30 along a line 75 (FIG. 1) such that the coupling element blank 68 has biting teeth 79,80 and 81,82 on the legs 76,77, respectively (FIGS. 7 and 8).

Figure 9:
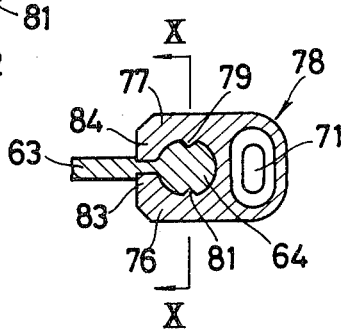
FIG. 9 is a cross-sectional view of the coupling element of FIG. 8 as clamped on a beaded edge of a stringer tape.
Figure 10:
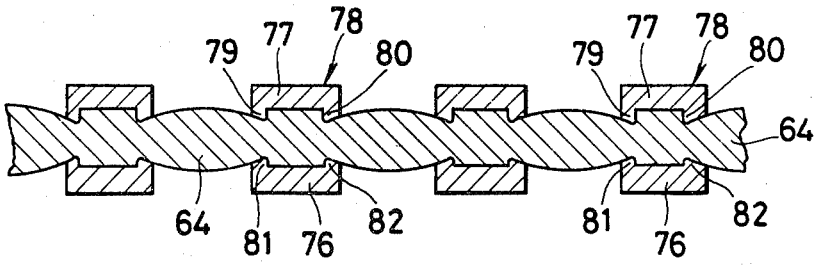
FIG. 10 is a cross-sectional view taken along line X—X of FIG. 9.

As shown in FIGS. 8 and 9, a coupling element 78 that is mounted on the stringer tape 63 has on the legs 76,77 a pair of thickened outer end portions ends or jaws 83,84, respectively, which grip the tape 63. The legs 76,77 are forcibly clamped around the beaded edge 64 so that the teeth 79–82 bite into the beaded edge 64 (FIG. 10). The coupling element 78 is secured to the stringer tape 63 with increased holding power against lateral or longitudinal pull tending to displace or dismount the coupling element 78.

Figure 11:
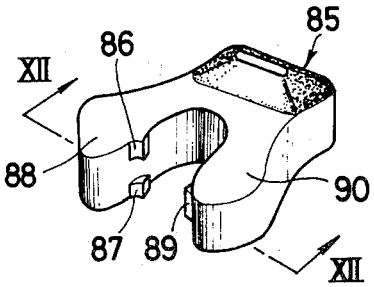
FIG. 11 is an enlarged perspective view of another slide fastener coupling element as completed in accordance with the present invention.
Figure 12:
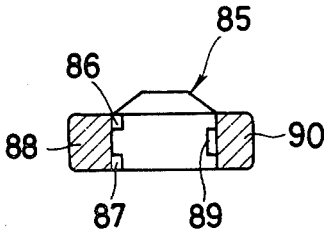
FIG. 12 is a cross-sectional view taken along line XII—XII of FIG. 11.
Figure 14:
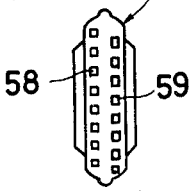
FIG. 14 is a plan view of a modified die roll.
Figure 13:
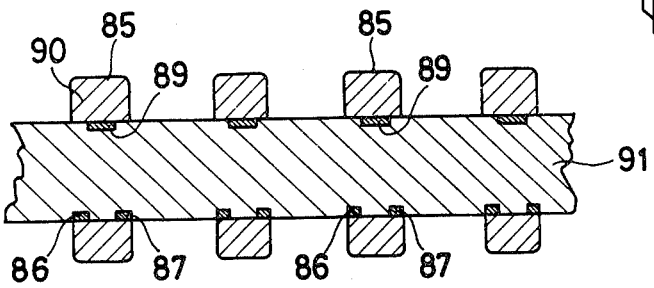
FIG. 13 is an enlarged fragmentary perspective view similar to FIG. 10, showing coupling elements of FIG. 11 which are mounted on a stringer tape.

As illustrated in FIGS. 11 through 13, a modified coupling element 85 has a pair of biting teeth 86,87 on the inner surface of one leg 88 and a single biting tooth 89 on the other leg 90, the tooth 89 being positioned in offset relation to the biting teeth 86,87. Such biting teeth 86,87 and 89 can be formed by a die roll 57 (FIG. 14) having one of series of die teeth 58 on the die roll 57 displaced out of alignment with another series of teeth 59 by half the pitch P about the rotational axis of the die roll 57. With this arrangement, the coupling element 85 is mounted more securely on a stringer tape beaded edge 91 (FIG. 13) since the teeth 86,87 and 89 bite into the beaded edge 91 in a complementary offset manner.

Although various minor modifications might be suggested by those versed in the art, it should be understood that I wish to embody within the scope of the patent warranted hereon, all such embodiments as reasonably and properly come within the scope of my contribution to the art.

What is claimed is:

1. A method of manufacturing slide fastener coupling elements comprising the steps of:

(a) forming a blank rod having a substantially Y-shaped cross section including a pair of V-shaped diverging legs having thickened outer end portions and having at their midportions a pair of respective confronting projecting longitudinal ribs on opposite inner surfaces thereof;

(b) intermittently feeding said blank rod in a longitudinal direction;

(c) pressing each of said longitudinal ribs at portions thereof longitudinally spaced an interval from each other to thereby leave a succession of rib increments between said pressed, longitudinally spaced portions of the rib for subsequently serving as teeth;

(d) transversely slicing said blank rod substantially centrally across each rib increment on at least one of said legs into a plurality of individual slide fastener coupling elements; and (e) forming a coupling head on each said coupling element.

2. An apparatus for manufacturing slide fastener coupling elements, comprising:

(a) means for forming a blank rod having a substantially Y-shaped cross section including a pair of V-shaped diverging legs having thickened outer end portions and having at their midportions a pair of respective confronting projecting longitudinal ribs on opposite inner surfaces thereof;

(b) means for intermittently feeding said blank rod in a longitudinal path;

(c) means for defining a closed surface bounding a Y-shaped space which is complementary with said Y-shaped cross section, said longitudinal path extending through said closed space, said surface including die means engageable with said inner surfaces of the legs for pressing each of said projecting ribs at portions thereof longitudinally spaced an interval from each other to thereby leave a succession of rib increments between said pressed, longitudinally spaced portions of the rib for subsequently serving as teeth;

(d) means for transversely slicing said blank rod substantially centrally across each rib increment on at least one of said legs into a plurality of individual slide fastener coupling elements; and (e) means for forming a coupling head on each said coupling element.

3. An apparatus according to claim 2, said defining means comprising four of rolls having axes lying in a common plane substantially perpendicular to said longitudinal path and peripheries jointly defining said closed surface, the periphery of one of said rolls being substantially V-shaped in cross section and having two opposite faces, said die means comprising a series of die teeth disposed circumferentially around each of said two opposite faces of said one of the rolls and spaced from each other by said interval.

* * * * *